US007451579B2

(12) United States Patent
Azarin

(10) Patent No.: US 7,451,579 B2
(45) Date of Patent: Nov. 18, 2008

(54) REINFORCEMENT BAR SPACER WHEEL

(75) Inventor: Michael Azarin, Dunwoody, GA (US)

(73) Assignee: Concrete Accessories, Inc., Norcross, GA (US)

( * ) Notice: Subject to any disclaimer, the term of this patent is extended or adjusted under 35 U.S.C. 154(b) by 223 days.

(21) Appl. No.: 11/248,393

(22) Filed: Oct. 12, 2005

(65) Prior Publication Data

US 2007/0094993 A1 May 3, 2007

(51) Int. Cl.
*E04C 5/16* (2006.01)

(52) U.S. Cl. ..... 52/677; 52/684; 248/74.3

(58) Field of Classification Search ..... 52/583.1, 52/677, 678, 689; 404/135, 136; D25/199; D8/384

See application file for complete search history.

(56) References Cited

U.S. PATENT DOCUMENTS 492,047 A * 2/1893 Otis et al. ..... 138/99
968,506 A * 8/1910 Blaha ..... 285/394
1,992,322 A * 2/1935 Nulf et al. ..... 81/3.32
2,428,391 A * 10/1947 Smith ..... 174/139
2,791,019 A * 5/1957 Du Laney ..... 249/124
3,280,529 A * 10/1966 Reuss ..... 52/689
3,292,335 A * 12/1966 Stober ..... 52/677
3,300,930 A 1/1967 Weise
3,348,347 A * 10/1967 Berry ..... 52/309.1
3,625,555 A * 12/1971 Scott et al. ..... 403/344
D223,701 S * 5/1972 Lausch ..... D8/356
3,679,250 A * 7/1972 Marsden ..... 403/313
3,694,989 A * 10/1972 Oliver et al. ..... 52/678
3,783,574 A 1/1974 Cennerelli
3,913,187 A * 10/1975 Okuda ..... 24/484
D241,116 S * 8/1976 Berry ..... D8/384
4,372,011 A * 2/1983 Aranyos ..... 24/20 TT
D307,541 S * 5/1990 Tres ..... D8/396
5,013,166 A * 5/1991 Domer ..... 384/220
5,347,787 A * 9/1994 Gavin ..... 52/677
5,400,562 A * 3/1995 Bahr ..... 52/684
5,470,165 A * 11/1995 Bissinger ..... 403/313

(Continued)

FOREIGN PATENT DOCUMENTS

DE 1270774 6/1968

(Continued)

OTHER PUBLICATIONS

Concrete Accessories, 1997, Concrete Accessories, Inc., Norcross, USA e.g. (coverpage; pp. 6-7).

(Continued)

*Primary Examiner*—Robert Canfield
*Assistant Examiner*—Brent W Herring
(74) *Attorney, Agent, or Firm*—Laurence P. Colton; Smith, Gambrell & Russell

(57) ABSTRACT

A spacer wheel for use in construction using reinforcement rods cast into a compound such as concrete. The spacer wheel is configured to space a reinforcement rod from adjacent surfaces as the as the concrete is cast into a mold. The spacer wheel is of a three part design and has a base section and left and right pivotable sections. The spacer wheel uses an integrally molded hinge to join each pivotable section to the base section. The design also uses a dual rack and paw mechanism to clamp the spacer wheel onto the reinforcement rod.

10 Claims, 7 Drawing Sheets

U.S. PATENT DOCUMENTS

| | | | | |
|---|---|---|---|---|
| 5,681,126 | A * | 10/1997 | Lin | 403/313 |
| 6,164,604 | A * | 12/2000 | Cirino et al. | 248/74.3 |
| 6,266,852 | B1 * | 7/2001 | Tai | 24/16 PB |
| 6,325,340 | B1 * | 12/2001 | Yonezawa | 248/74.1 |
| 6,385,938 | B1 * | 5/2002 | Gavin | 52/677 |
| 6,772,570 | B2 * | 8/2004 | Horne | 52/655.1 |
| 6,830,517 | B1 * | 12/2004 | Ciraolo | 472/118 |
| 7,017,867 | B2 * | 3/2006 | Sono | 248/74.1 |
| 2007/0094003 | A1 | 4/2007 | Huang et al. | |

FOREIGN PATENT DOCUMENTS

| | | | |
|---|---|---|---|
| EP | 0 352 438 | | 5/1989 |
| GB | 2088434 | A * | 6/1982 |

OTHER PUBLICATIONS

Seifert Rebar Spacers 93, 1993, Gebr. Seifert GmbH + Co., Schalksmuehle, Germany, e.g. (coverpage; pp. 12-14).

Betomax Product Range, Kunststoff un Metallwarenfabrik GmbH & Co., Neuss, Germany, e.g. (p. 53).

Joyce B. Klemmer, John R. Horvack, Defendant Concrete Accessories, Inc.'s Objections and Responses to Plaintiffs' First Set of Interrogatories, Feb. 2008, Atlanta, USA.

* cited by examiner

REINFORCEMENT BAR SPACER WHEEL

BACKGROUND OF THE INVENTION

1. Field of the Invention

The present invention generally relates to structural spacers and positioners. More particularly, the present invention relates to a spacer wheel for use in construction with reinforcement rod. The spacer wheel restrains the reinforcement rod a distance from any adjacent surfaces as the reinforcement rod is cast into a compound such as concrete. The spacer wheel is of unitary construction, is easily installed, and may be used with a variety of diameter of reinforcement rods.

2. Description of the Related Art

Concrete structures often require or contain steel reinforcement bars, also called rebar, to increase the strength of the structure. While concrete has tremendous strength in compression, it has less strength in tension. Rebar improves the strength of concrete in tension. Rebar typically is laid in the desired pattern prior to the pouring of the concrete. The concrete then is poured about the rebar and allowed to harden about the rebar. At times, the rebar ends up in a less than optimal position within the concrete, either too close to the surface or too close to another rebar. Spacer wheels are known in the art and are used to positively position the rebar within the concrete. Many of the known spacer wheels can be difficult to position on the rebar or fall off of the rebar, thus becoming useless and possibly a hindrance to the formation of a desired concrete structure.

Accordingly, it would be advantageous to provide a device for spacing reinforcement rods from adjacent surfaces that may be securely clamped onto the reinforcement rod. Such a device should be easily and quickly installed on the reinforcement rod and be capable of being easily removed or repositioned on the reinforcement rod. The device should incorporate a secure and reliable clamping means to clamp the spacer wheel onto the reinforcement rod. The device should be easily manufactured in high volume and inexpensive to produce. It is thus to such a spacer wheel device that the present invention is primarily directed.

BRIEF SUMMARY OF THE INVENTION

The disadvantages of the prior art are overcome by the present invention which, in one aspect, is a spacer wheel for use in construction using reinforcement rods cast into a compound. The spacer wheel is used to space a reinforcement rod from adjacent surfaces. The spacer wheel has a first axial side, and an opposing second axial side. The spacer wheel also has a base section having a first saddle surface and a first outer circular edge. A first pivotable section has a second saddle surface and a second outer circular edge. A second pivotable section has a third saddle surface and a third outer circular edge. A first hinge section connects the first pivotable section to the base section. A second hinge section connects the second pivotable section to the base section.

And wherein at installation of the spacer wheel on the reinforcement rod; the first pivotable section pivots about the first hinge section towards the base section, and the second pivotable section pivots about the second hinge section towards the base section, thereby capturing the reinforcement rod between the first, second and third saddle surfaces and wherein the reinforcement rod is spaced from adjacent surfaces by the first, second and third outer circular edges.

In an alternative embodiment, the spacer wheel further comprises a latching means for latching the first pivotable section proximate to the second pivotable section. The latching means may allow the first pivotable section to be latched at a plurality of positions proximate to the second pivotable section. The latching means may comprises at least one rack and paw mechanism. The rack and paw mechanism having the rack facing the first axial side of the spacer wheel and the paw facing the second axial side of the spacer wheel. In yet another alternative embodiment, the latching means may be released by deflection of the paw away from the rack.

In yet another alternative embodiment the latching means comprises a plurality of snaps.

In yet another alternative embodiment the spacer wheel has at least one raised ridge forming a portion of at least one of the first, second or third saddle surfaces. At installation, when the spacer wheel is clamped around the reinforcement rod, the reinforcement rod contacts the at least one saddle surface, at the at least one raised ridge.

In yet another alternative embodiment the spacer wheel has a first guide ramp forming a portion of the first pivotable section. A second guide ramp forms a portion of the second pivotable section. And wherein when the spacer wheel is placed over the reinforcement rod, the reinforcement rod is guided by the first and second guide ramps to a position between the first, second and third saddle surfaces.

In yet another alternative embodiment, the spacer wheel comprises a plurality of raised ribs extending radially outward from at least one of the first, second and third outer circular edges.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
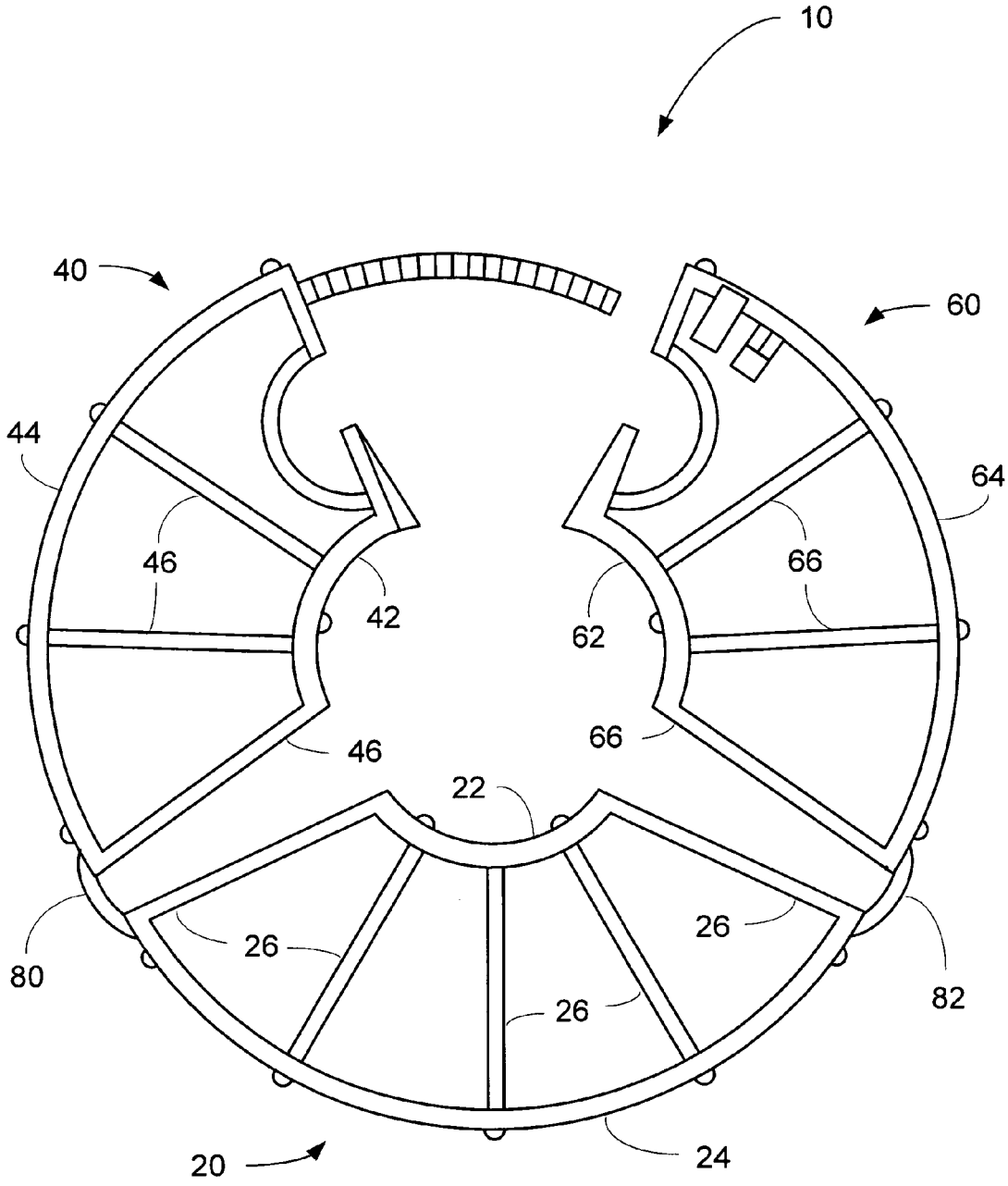
FIG. 1 is a side view of the spacer wheel in the as molded shape

With reference to the figures in which like numerals represent like elements throughout, FIG. 1 a side view of one embodiment of the spacer wheel 10 for use in concrete construction. The spacer wheel is comprised of three main segments; a base portion 20, a left pivotable portion 40, and a right pivotable portion 60. The base portion 20 has an inner saddle surface 22 and an outer edge 24. The saddle surface 22 and outer edge 24 are connected by radial ribs 26. In a similar fashion, the left and right pivotable portions 40, 46 have an inner saddle surface 42, 62 and an outer edge 44, 64, with the saddle surface 42, 62 connected to the outer edge 44, 64 by radial ribs 46, 66 respectively.

As further shown in FIG. 1, the base portion 20, and the left and right pivotable portions 40, 60 are connected by hinges 80, 82. The hinges 80, 82 are molded in place and are substantially less structurally stiff than the base portion 20, and the left and right pivotable portions 40, 60 and are designed to accommodate the required deflection of the left pivotable portion from the right pivotable portion. The spacer wheel 10 is molded as a single component and may be formed by injection molding a plastic, or by other means as are readily known by one skilled in the art. The plastic compound used may be ABS, Styrene or another plastic compound chosen for the strength, elasticity and economy as required in the application.

Figure 2:
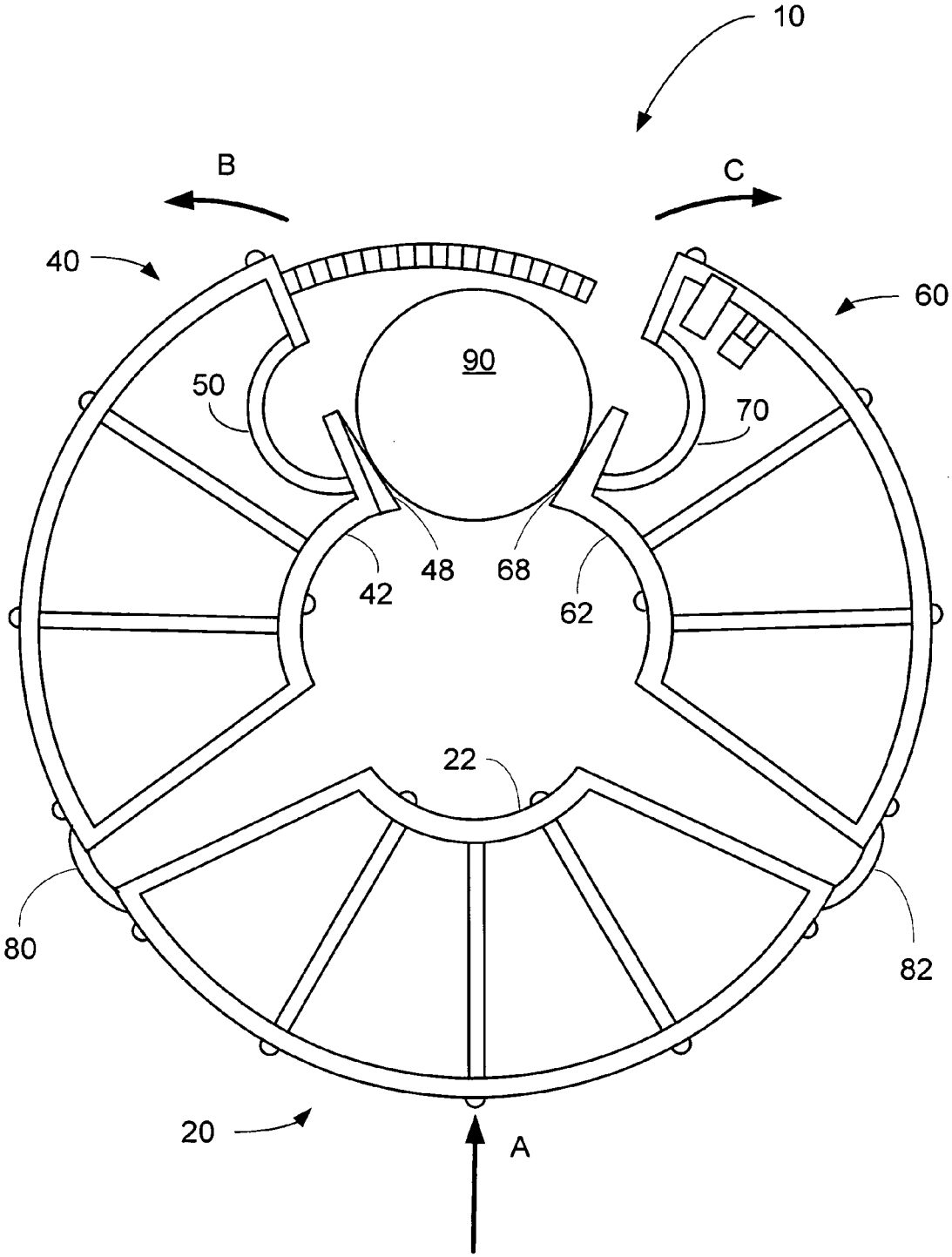
FIG. 2 is a side view of the apparatus of FIG. 1, illustrating the spacer wheel being positioned upon a reinforcement rod.

As shown in FIG. 2, the spacer wheel 10 may be positioned over a reinforcement rod 90 by pushing the spacer wheel 10 radially onto the rod in the direction of Arrow A. In this manner, multiple spacer wheels 10 may be readily installed at points along the axial length of a reinforcement rod 90.

As the spacer wheel 10 is positioned over the reinforcement rod 90, the reinforcement rod 90 contacts guide ramps 48, 68 which are molded integral with the left and right pivotable portions 40, 60. The guide ramps 48, 68 are joined to the left and right pivotable portions 40, 60 by spring ribs 50, 70. As the spacer wheel is pressed in the direction of Arrow A, the guide ramps 48, 68 urge the pivotable portions 40, 60 to rotate open in the direction of the Arrows B and C respectively. The left and right pivotable portions 40 and 60 spread apart by deflection of the hinges 80, 82 to allow the body of reinforcement rod 90 to pass thru and capture the spacer wheel 10 over the reinforcement rod 90. The spring ribs 50, 70 allow some deflection of the guide ramps 48, 68 to further aid in the installation.

Figure 3:
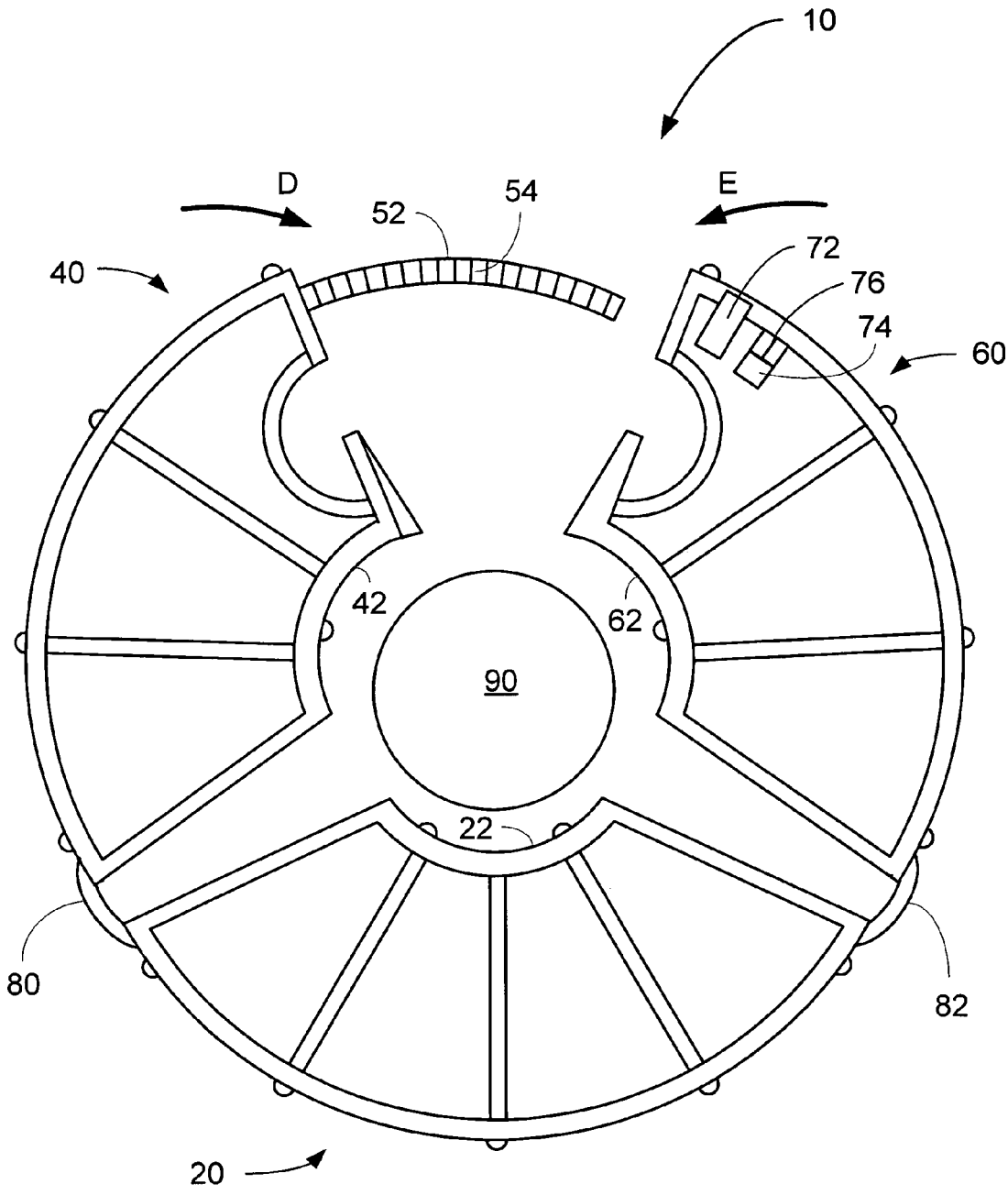
FIG. 3 is a side view of the apparatus of FIG. 1, illustrating the spacer wheel being captured over the reinforcement rod.

As depicted in FIG. 3, the spacer wheel 10 has been positioned on the reinforcement rod 10. After the reinforcement rod passes between the left and right pivotable portions 40, 60 the elasticity of hinges 80, 82 urge the pivotable sections 40, 60 to rotate back into their as molded positions in the direction of Arrows D and E. The spacer wheel 10 is then captured over the reinforcement rod between the inner saddle surfaces 22, 42, and 62.

The cross section of the hinges 80 and 82 are designed to accommodate the deflection required to allow positioning of the spacer wheel over the reinforcement rod. The hinges 80, 82 also provide a suitable spring force to urge the pivotable sections 40 and 60 back together into the as molded shape after positioning. The use of the three portion spacer wheel design having a base portion, with left and right pivotable portions, allows for the use of the dual hinges 80, 82. The dual hinges 80, 82 result in each hinge being required to bear only one-half of the deflection required to allow positioning of the spacer wheel 10 over the reinforcement rod 10. The material of each hinge 80, 82 is subjected to approximately one half of the deflection stress experienced in the prior art two part spacer wheel designs. The cross sectional shape of the hinges 80, 82 is designed based on the spring rate desired, and the material properties of the plastic selected to mold the spacer wheel 10.

As further shown in FIG. 3, an arm 52 extends from adjacent the outer edge 44 of the left pivotable portion 40 in the direction of the right pivotable portion 60. The arm 52 has teeth 54 molded along the outer surface. The left pivotable portion 60 has latches 72, 74 which are molded adjacent its outer edge 64. Each latch 72, 74 has teeth 76 molded along the body and configured to engage the teeth 54 of the arm 52.

Figure 4:
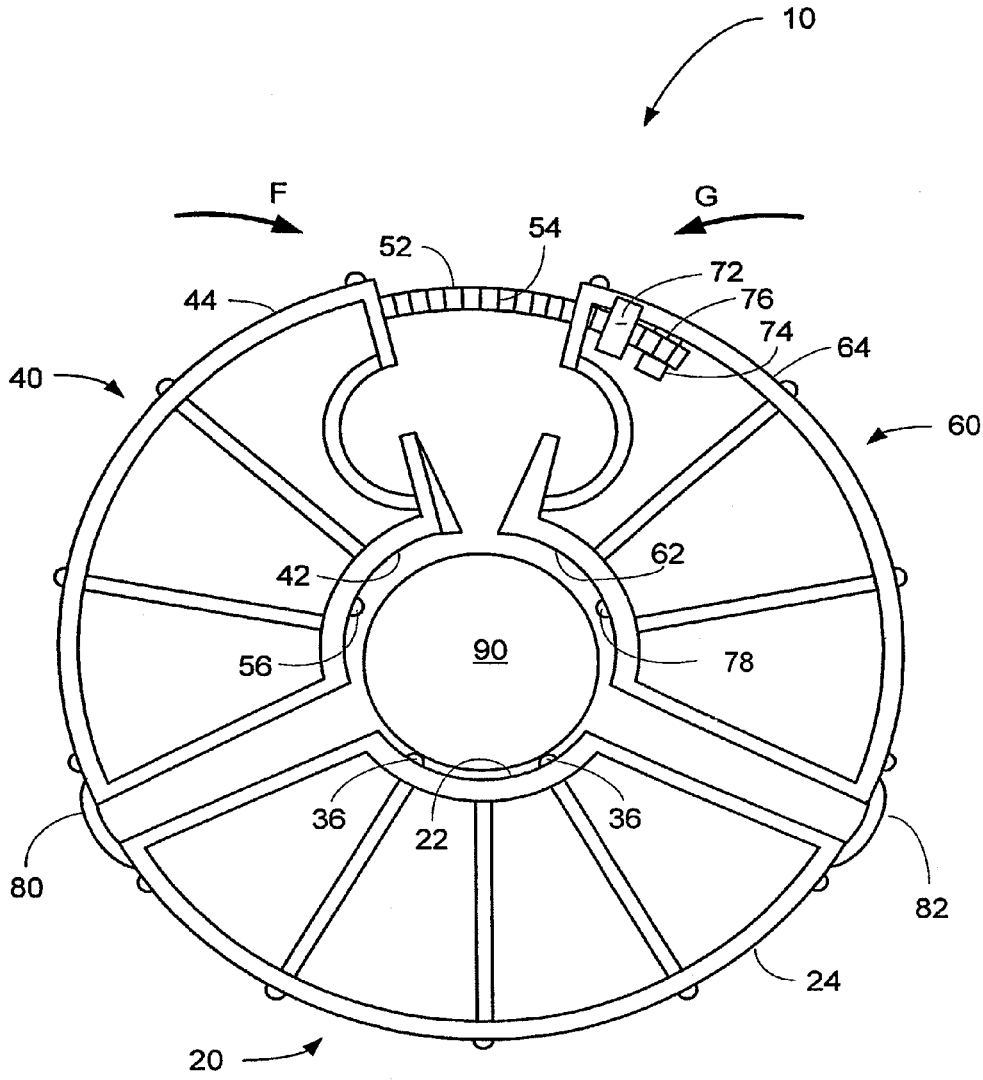
FIG. 4 is a side view of the apparatus of FIG. 1, illustrating clamping the spacer wheel onto the reinforcement rod using a latching mechanism.

As shown in FIG. 4, the spacer wheel 10 is then clamped around the reinforcement bar 90 by squeezing left and right pivotable portions 40, 60 together in the direction of Arrows F and G. As the left and right pivotable portions 40, 60 are initially squeezed together, the arm 52 is engaged by the latches 72, 74. As the left and right pivotable portions 40, 60 are further squeezed together, the spacer wheel 10 is clamped around the reinforcement bar 90 by the saddle surfaces 22, 42, 62. The left and right pivotable portions 40, 60 are then restrained together by teeth 54 the arm 52 engaging the teeth 76 latches 72, 74.

A toothed arm 52 which engages a latch 72, 74 is typically known as a rack and paw mechanism by one skilled in the art, with the rack taking the form of the arm 52 and the paw taking the form of latch 72, 74. The use of the plurality of teeth 54 on the arm 52 allows the clamping of the arm within the latches 72, 74 at multiple positions. This multiple teeth feature allows the clamping of the spacer wheel 10 onto a range of reinforcement rod 10 diameters by simply squeezing the left and right pivotable portions 40, 60 together until the spacer wheel tightly grips the reinforcement rod. Other clamping means may be used to restrain the left and right pivotable portions 40, 60 together at a plurality of positions, such as plastic snaps, hook and loop fastener, or other means as are readily known to one skilled in the art.

As further shown in FIGS. 3 and 4, the three saddle surface 22, 42, 62 design exerts a uniform clamping pressure on the reinforcement rod 90 since the reinforcement rod is effectively clamped from three directions, as compared to two directions in the prior art designs. Additionally the reinforcement rod 90 is more readily captured at installation by the three saddle surfaces 22, 42, 62 surrounding the rod.

Figure 5:
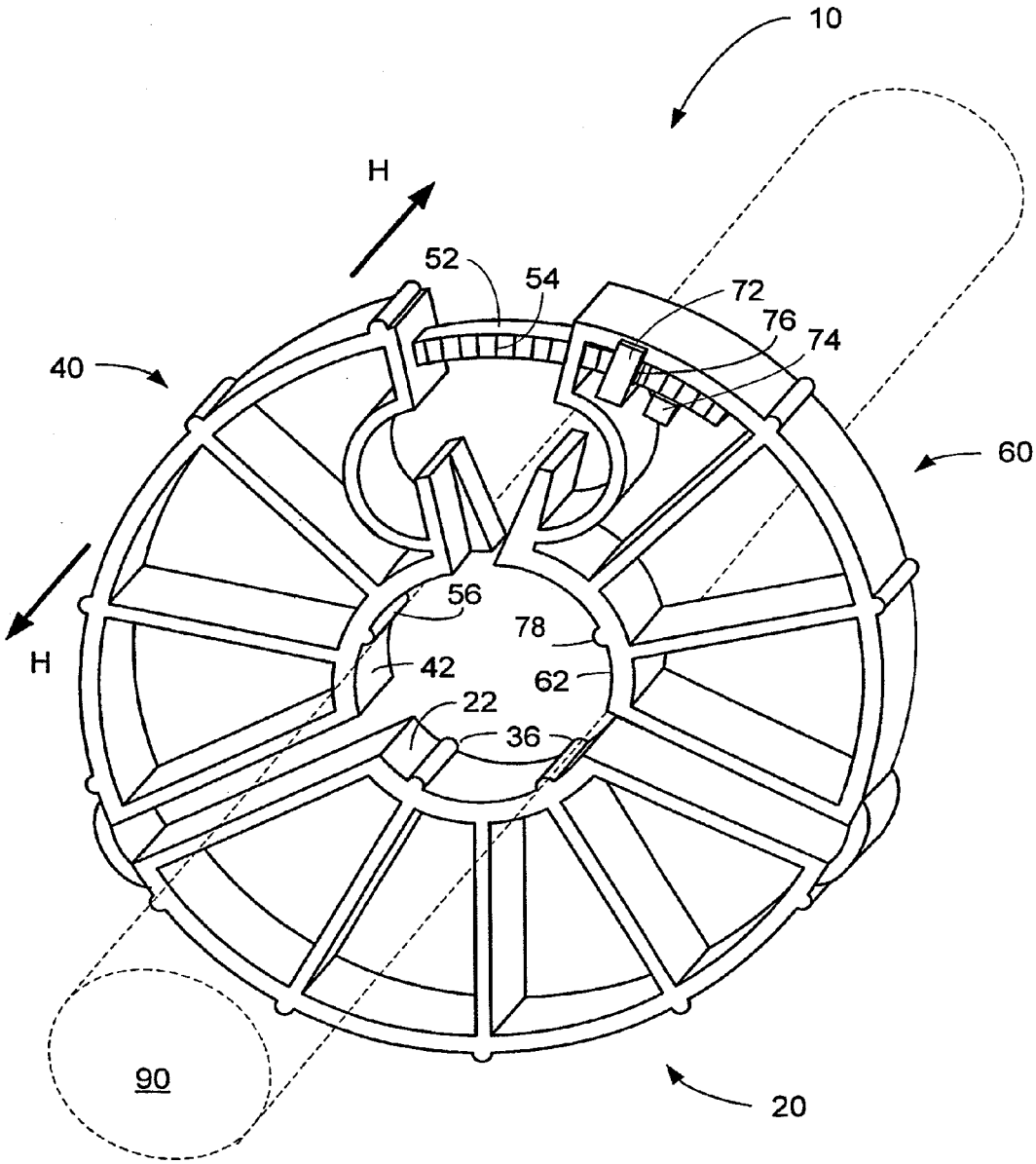
FIG. 5 is a side-perspective view of the apparatus of FIG. 1, illustrating the spacer wheel clamped onto a reinforcement rod and the direction of pull for the injection mold halves used to form the spacer wheel.

As shown in FIG. 5, each saddle surface 22, 42, 62 has a raised ridge 36, 56, 78 extending axially down the saddle surface. The raised ridges 36, 56, 78 are spaced about the circumference of each saddle surface 22, 42, 62 to provide a positive grip on the reinforcement bar 90 by the spacer wheel 10. The raised ridges 36, 56, 78 define the location of the line of contact between each saddle surface 22, 42, 62 and a reinforcement bar 90 for the range of reinforcement bar sizes the spacer wheel 10 is designed to receive. The line contact ensures the spacer wheel 10 is held perpendicular to the reinforcement rod 90 with a high resistance to cocking, thus keeping the spacer wheel in position as concrete is poured around the reinforcement rod and spacer wheel.

As shown in FIGS. 4 and 5, the use of twin latches 72, 74 in the spacer wheel 10 design provides for a secure and redundant grip on the arm 52 which is capable of supporting a high amount of clamping pressure. The latches 72, 74 face opposing sides of the spacer wheel 10, and the teeth 76 of each latch face in opposing directions. The arm 52 also has teeth 54 molded on corresponding opposing sides. The injection molding of the spacer wheel is simplified by this opposing teeth configuration as the design allows for twin latches 72, 74 without an undercut on either mold cavity. The design provides an optimum direction pull of the mold halves, shown in FIG. 5 in the direction of Arrows H, for forming of the teeth 54 on the arm 52 and for the forming of the teeth 76 on the latches 72, 74. The molding of consistent teeth 54, 76 on the latching components 52, 72, 74 is critical to a positive and repeatable latching of the spacer wheel 10 which is capable of sustaining a high amount of clamping pressure on the reinforcement bar 90.

Figure 6:
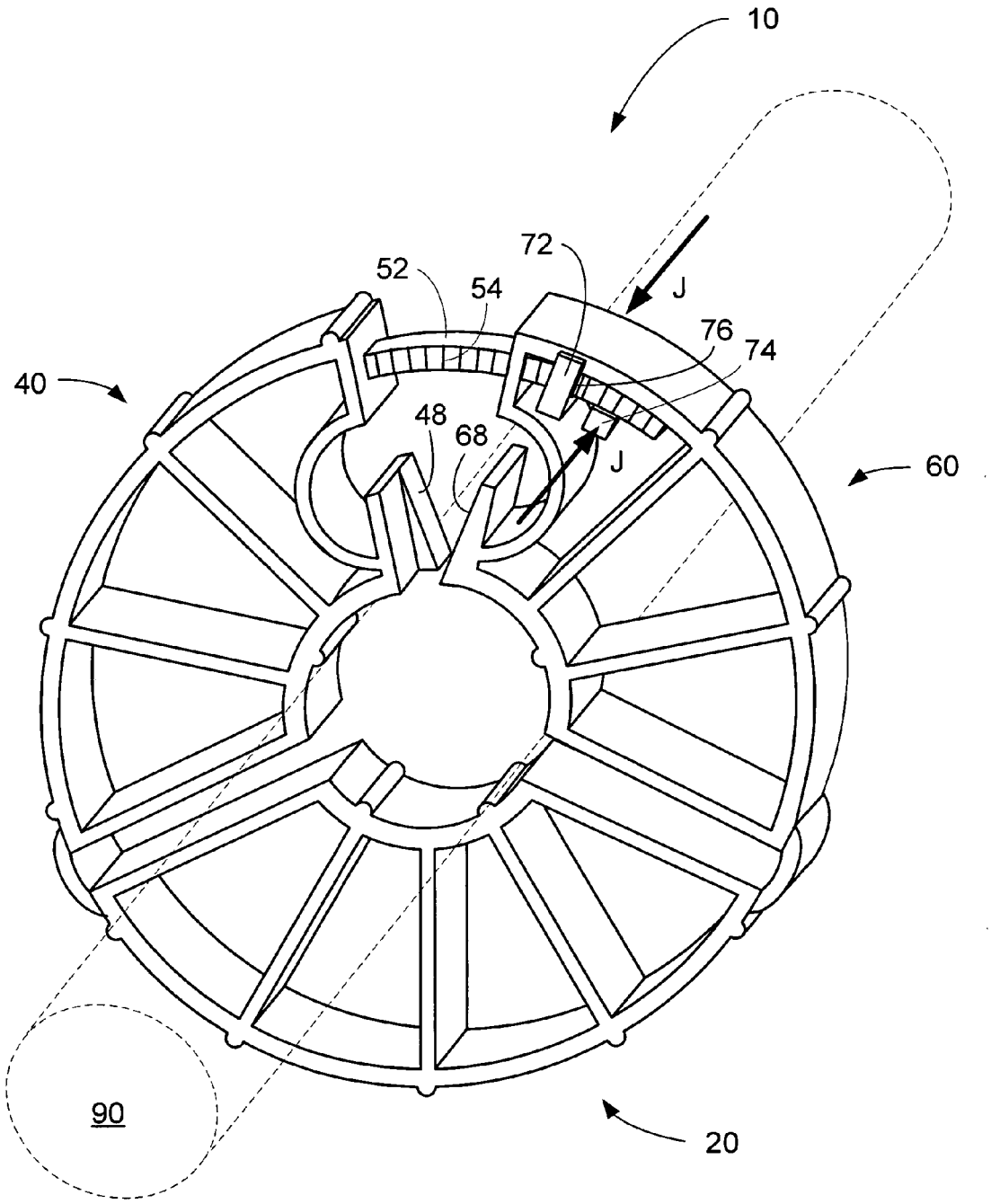
FIG. 6 is a side-perspective view of the apparatus of FIG. 1, illustrating unclamping the spacer wheel from a reinforcement rod and guide ramps for the installation of the spacer wheel on the rod.

As shown in FIG. 6, the latches 72, 74 may be released by applying pressure in the direction of Arrows J to deflect the teeth 76 of the latches 72, 74 away from the teeth 54 of the arm 52, thereby releasing the arm from the latch. In this manner the spacer wheel 10 may be easily unclamped and repositioned on the reinforcement rod 90. The use of opposing latches 72, 74 allows for single handed release of the clamping pressure by squeezing the latches between the thumb and forefinger of one hand.

As further shown in FIG. 6, the guide ramps 48, 68 are molded integral with the left and right pivotable portions 40, 60. The guide ramp 48 is formed adjacent one side of the spacer wheel 10, and the guide ramp 68 is formed adjacent the opposing side of the spacer wheel. This opposing configuration in the design allows for dual guide ramps 48, 68 of a relatively large size without either guide ramp interfering with the other as the spacer wheel 10 is clamped about the reinforcement bar 90. The guide ramps 48 and 68 are drawn down at opposing sides of the spacer wheel 10 and do not contact one another, even when claiming the smallest sizes of reinforcement bar 90. The large guide ramps 48, 68 are capable of reliably guiding the spacer wheel 10 onto the range of reinforcement bar sizes the spacer wheel is designed to receive. The injection molding of the spacer wheel 10 is again simplified by the opposing guide ramp design which allows for the large guide ramps 48, 68 without an undercut on either mold cavity.

Figure 7:
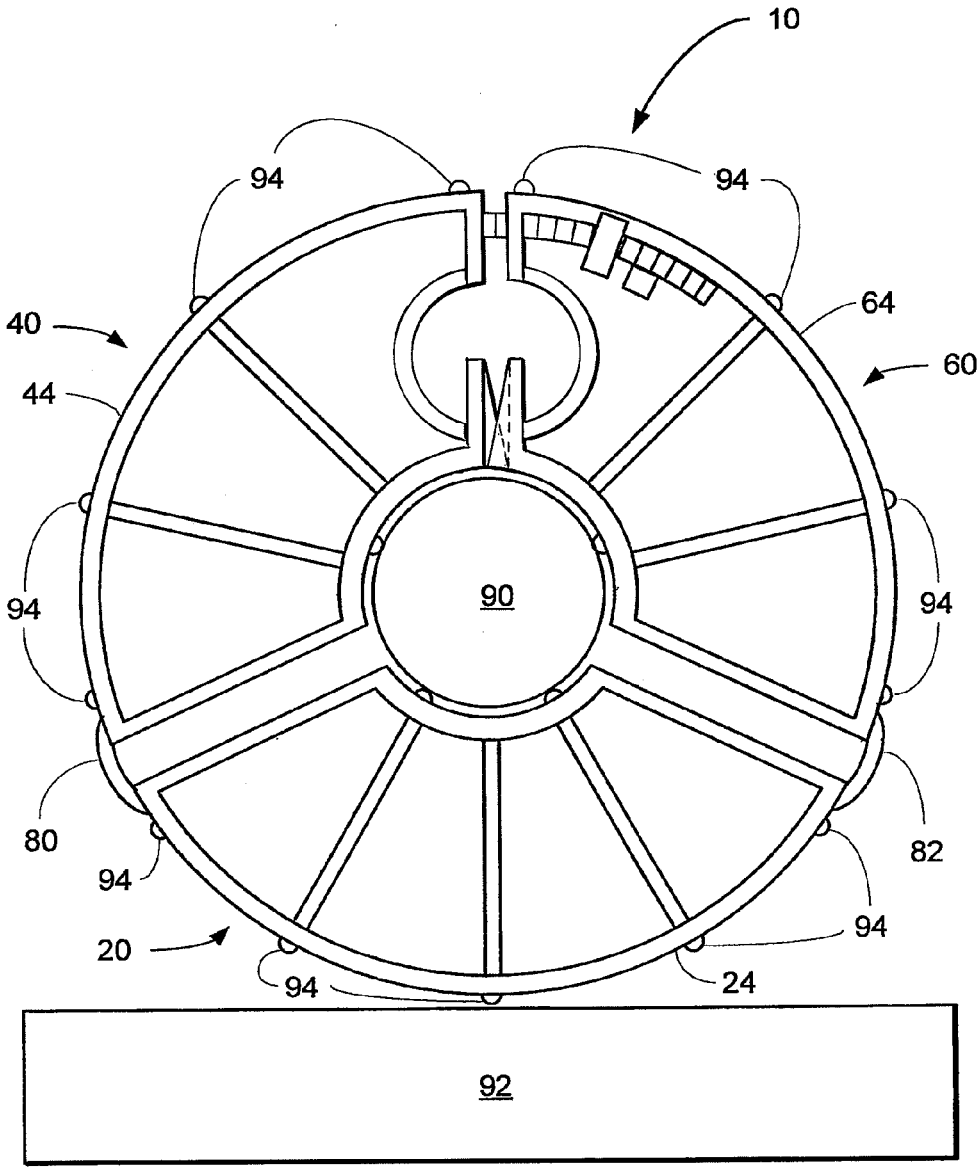
FIG. 7 is an assembly view illustrating the apparatus of FIG. 1 adjacent a surface onto which concrete is to be cast.

As shown in FIG. 7, a spacer wheel 10 is installed and clamped about a reinforcement rod 90. The outer edges 24, 44, 64 of the spacer wheel 10 space the reinforcement rod 90 a set distance from any adjacent surfaces 92 as the rod and spacer wheel are cast in place. A plurality of raised ribs 94 extend from each outer edge 24, 44, 64 and ensure only line contact with any adjacent surfaces 92. The line contact at the raised ribs 94 prevents a blemish in the molded concrete surface by the protrusion or visibility of the edge of spacer wheel 10 in the finished concrete panel.

The spacer wheel of the description above meets the objects of the present invention. Installation of the spacer wheel onto a reinforcement rod is simple and quick. The spacer wheel is positioned on the rod and simply squeezed shut with hand pressure. The spacer wheel self-centers on and is locked perpendicular to the reinforcement rod and is highly resistant to cocking in heavy use. The twin latches provide a redundant latching feature and provide a high clamping pressure on the spacer wheel onto the reinforcement bar. If necessary, the spacer wheel may be removed or repositioned on the rod without damage to the spacer wheel or loss of clamping pressure/cocking resistance when reinstalled on the reinforcement rod.

The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A spacer wheel for use in construction using reinforcement rods cast into a compound, the spacer wheel spacing a reinforcement rod from adjacent surfaces, the spacer wheel having a first axial side, and an opposing second axial side, the spacer wheel comprising:

a base section, the base section having a first saddle surface and a first outer circular edge;

a first pivotable section, the first pivotable section having a second saddle surface, a second outer circular edge, and having a first guide ramp extending from the first axial side of the spacer wheel;

a second pivotable section, the second pivotable section having a third saddle surface, a third outer circular edge and having a second guide ramp extending from the second axial side of the spacer wheel;

a first hinge connection the first pivotable section to the base section;

a second hinge connecting the second pivotable section to the base section; and wherein the first pivotable section and the second pivotable section pivot independently relative to the base section and the reinforcement rod is captured between the first, second and third saddle surfaces.

wherein a portion of the first guide ramp overlaps a portion of the second guide ramp, at least when the spacer wheel is clamped about the reinforcement rod;

wherein when the spacer wheel is positioned over the reinforcement rod, the first guide ramp urges the first pivotable section to pivot about the first hinge section away from the base section, and the second guide ramp urges the second pivotable section to pivot about the second hinge section away from the base section, thereby allowing placement of the spacer wheel over the reinforcement rod; and wherein after positioning the spacer wheel over the reinforcement rod, the first pivotable section pivots about the first hinge towards the base section, the second pivotable section pivots about the second hinge towards the base section, a portion of the first guide ramp overlaps a portion of the second guide ramp on opposing axial sides of the spacer wheel, thereby capturing the reinforcement rod between the first, second and third saddle surfaces and wherein and the reinforcement rod is spaced from adjacent surfaces by the first, second and third outer circular edges.

2. The spacer wheel of claim 1, further comprising a latch for latching the first pivotable section proximate to the second pivotable section.

3. The spacer wheel of claim 2, wherein the first pivotable section may be latched at a plurality of positions proximate to the second pivotable section.

4. The spacer wheel of claim 3, wherein the latch comprises at least one rack and pawl mechanism.

5. The spacer wheel of claim 3, wherein the latch comprises a plurality of snaps.

6. The spacer wheel of claim 2, wherein the latch further comprises:

a first rack and pawl mechanism, the first rack facing the first axial side of the spacer wheel and the first pawl facing the second axial side of the spacer wheel, and a second rack and pawl mechanism, the second rack facing the second axial side of the spacer wheel and the second pawl facing the first axial side of the spacer wheel.

7. The spacer wheel of claim 2, wherein the latch may be released by deflection of a portion of the latch.

8. The spacer wheel of claim 2, wherein the latch comprises:

at least one rack and pawl mechanism; and wherein the latch may be released by deflection of the pawl away from the rack.

9. The spacer wheel of claim 1, further comprising:

at least one raised ridge forming a portion of at least one of the first, second or third saddle surfaces; and wherein the reinforcement rod contacts the at least one saddle surface at the at least one raised ridge.

10. The spacer wheel of claim 1, further comprising a plurality of raised ribs extending radially outward from at least one of the first, second or third outer circular edges.

* * * * *